US010428483B2

(12) United States Patent
Prévost

(10) Patent No.: US 10,428,483 B2
(45) Date of Patent: Oct. 1, 2019

(54) ANCHOR SYSTEM

(71) Applicant: LES SURFACES SPORTIVES PREVOST INC., St-Paul d'Abbotsford (CA)

(72) Inventor: Jacques Prévost, St-Paul d'Abbotsford (CA)

(73) Assignee: LES SURFACES SPORTIVES PREVOST INC., St. Paul d'Abbotsford, Quebec (CA)

( * ) Notice: Subject to any disclaimer, the term of this patent is extended or adjusted under 35 U.S.C. 154(b) by 0 days.

(21) Appl. No.: 15/950,691

(22) Filed: Apr. 11, 2018

(65) Prior Publication Data

US 2018/0298578 A1 Oct. 18, 2018

Related U.S. Application Data

(60) Provisional application No. 62/484,546, filed on Apr. 12, 2017.

(51) Int. Cl.
*E02D 5/74* (2006.01)
*E02D 5/80* (2006.01)

(52) U.S. Cl.
CPC ..... *E02D 5/801* (2013.01); *E02D 5/803* (2013.01)

(58) Field of Classification Search
CPC ..... E04H 12/2215; E04H 17/22; E02D 27/12; E02D 35/00; E02D 5/28; E02D 27/50; E02D 27/16; E02D 5/801; E02D 5/56
See application file for complete search history.

(56) References Cited

U.S. PATENT DOCUMENTS 3,382,628 A * 5/1968 Waite ..... E02D 5/801 52/157
4,290,245 A * 9/1981 Pardue, Jr. ..... E02D 5/801 52/157
4,334,392 A * 6/1982 Dziedzic ..... E02D 5/801 175/400
5,295,766 A * 3/1994 Tiikkainen ..... E02D 5/34 405/232
6,682,267 B1 * 1/2004 Jones ..... E02D 5/523 405/230
8,220,209 B2 7/2012 Roy et al.
(Continued)

FOREIGN PATENT DOCUMENTS

WO WO2015/063803 * 5/2015

*Primary Examiner* — Gisele D Ford
(74) *Attorney, Agent, or Firm* — Thomas | Horstemeyer, LLP

(57) ABSTRACT

An anchor system for anchoring an object to the ground is provided. The anchor system includes a base assembly for installing in the ground, the base assembly including a lower section securable in the ground, and an upper section having a substantially planar top surface. The upper section is adjustably secured to the lower section for adjusting an overall height of the base assembly. A retractable anchoring member is secured to the upper section and is adjustable between an operating position in which it extends above the top surface of the upper section, and a retracted configuration in which it is concealed below the top surface of the upper section. In an exemplary configuration, the anchoring member is pivotally secured to the upper section and can be pivoted between the operating position and the retracted configuration.

19 Claims, 11 Drawing Sheets

(56) References Cited

U.S. PATENT DOCUMENTS

| | | | | |
|---|---|---|---|---|
| 2004/0105727 | A1* | 6/2004 | Jones | E02D 5/523<br>405/231 |
| 2006/0051183 | A1* | 3/2006 | Powell | E02D 5/801<br>411/386 |
| 2014/0259991 | A1* | 9/2014 | Atchley | E02D 5/805<br>52/157 |
| 2016/0215470 | A1* | 7/2016 | Reusing | E02D 5/56 |
| 2018/0030753 | A1* | 2/2018 | Cavasino | E04H 12/2223 |

* cited by examiner

ANCHOR SYSTEM

RELATED PATENT APPLICATION

The present application claims priority from U.S. provisional patent application No. 62/484,546, the contents of which are incorporated herein by reference.

TECHNICAL FIELD

The technical field generally relates to anchors for securing objects to the ground. More particularly, it relates to anchors which are height adjustable and/or which can be retracted when not in use.

BACKGROUND

Ground anchors are used in a number of different contexts to secure objects to the ground. For example, ground anchors are commonly used to secure structures such as fabric enclosures, vehicles such as mobile homes or airplanes, sporting equipment, etc., to stabilize them and/or prevent theft. Disadvantageously, existing ground anchors have a number of deficiencies, and there is room for improvement.

SUMMARY

According to an aspect, an anchor system for anchoring an object to the ground is provided. The anchor system includes: a base assembly for installing in the ground, the base assembly including a lower section securable in the ground, and an upper section having a substantially planar top surface, said upper section being adjustably secured to the lower section for adjusting an overall height of the base assembly; and a retractable anchoring member including an anchoring point, the retractable anchoring member being secured to the upper section and being adjustable between an operating position in which the anchoring point extends above the top surface of the upper section, and a retracted configuration in which the anchoring point is concealed below the top surface of the upper section.

According to an aspect, an anchor system for anchoring an object to the ground is provided. The anchor system includes: a base assembly for installing in the ground, the base assembly including a body having a substantially planar top surface; and an anchoring member pivotally secured to the base assembly for anchoring the object to the base assembly, said anchoring member being pivotable about a pivot axis parallel to the planar top surface between a retracted position in which the anchoring member is flush with the top surface of the base assembly, and an operating position in which the anchoring member protrudes from the top surface of the base assembly.

According to an aspect, a kit for anchoring an object to the ground is provided. The kit includes: an anchor system including: a base assembly for installing in the ground, the base assembly including a lower section securable in the ground, and an upper section having a substantially planar top surface, said upper section being adjustably secured to the lower section for adjusting an overall height of the base assembly; and an anchoring member pivotally secured to the base for anchoring the object to the base assembly, the anchoring member being configured as a closed loop and including a unitary body defining a central aperture, the anchoring member being pivotable between an operating position in which the central aperture is exposed above the top surface of the base assembly, and a retracted position in which the central aperture is exposed below the top surface of the base assembly; a tethering device for inserting through the central aperture of anchoring member while in the operating position, said tethering device having first and second ends; and a locking device for locking the first and second ends of the tethering device together to form a closed loop.

DETAILED DESCRIPTION

Figure 1A:
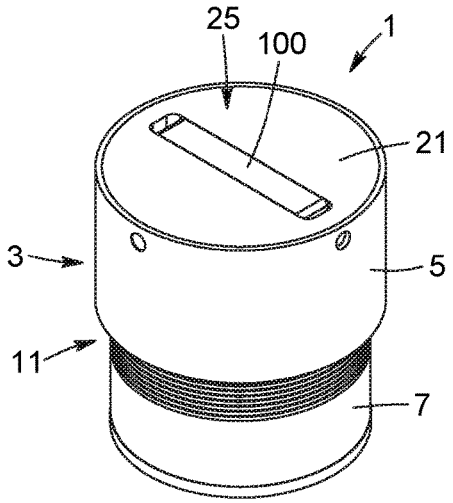
FIG. 1A is a perspective view of an anchor system according to an embodiment, showing the anchoring member in a retracted configuration.
Figure 1B:
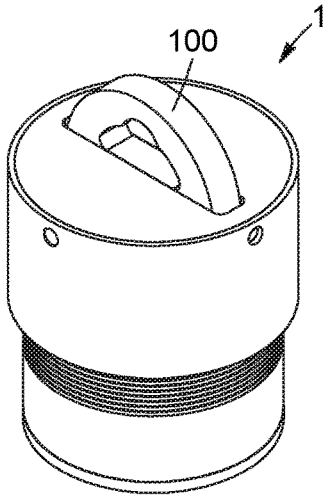
FIG. 1B is a perspective view of the anchoring system of FIG. 1A showing the anchoring member in an operating configuration.
Figure 2A:
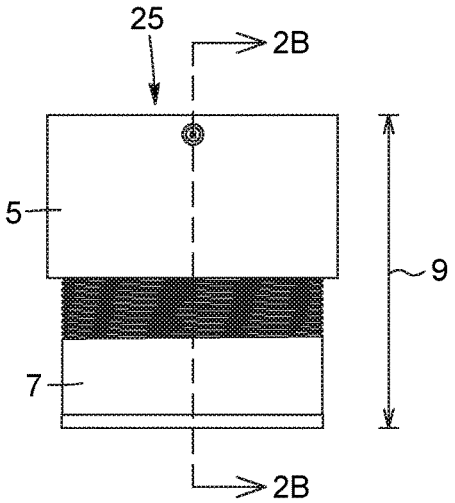
FIG. 2A is a side view of the anchor system of FIG. 1A.
Figure 2B:
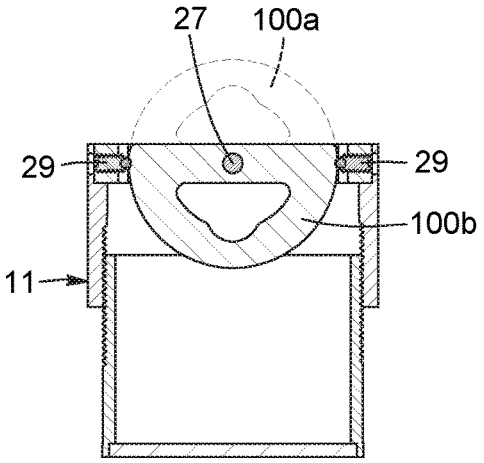
FIG. 2B is a cross sectional view of the anchor system of FIG. 2A taken along line 2B-2B.

In the following description, the same numerical references refer to similar elements. Furthermore, for the sake of simplicity and clarity, namely so as to not unduly burden the figures with several references numbers, not all figures contain references to all the components and features. References to some components and features may be found in only one figure, and components and features illustrated in other figures can be easily inferred therefrom. The embodiments, geometrical configurations, materials mentioned and/or dimensions shown in the figures are preferred, for exemplification purposes only.

With reference to FIGS. 1A to 2B, an anchor system 1 is shown according to an embodiment. Broadly described, the anchor system 1 provides a mechanism for anchoring objects to the ground. The anchor system 1 is configurable to provide a flat surface when not in use, and to have an adjustable height such that the flat surface can be flush with the ground even when the ground surface sinks, for example due to settling, and/or when the ground surface rises, for example due to grass growing in the ground.

The anchor system 1 comprises a base assembly 3 for installing in the ground. In the present embodiment, the base assembly 3 is substantially cylindrical in shape, however it is appreciated that other shapes are also possible. Preferably, the base assembly 3 is heavy and rigid, and is made from materials which are suitable for outdoor use and can withstand exposure to the elements. For example, in the present embodiment, the base assembly 3 is made from metal, such as stainless steel, and is preferably covered in a protective coating, such as a plastic or rubber coating. It is appreciated, however, that other materials can be used. For example, the base assembly 3 can be made from a rigid, temperature and UV stable plastic, such as PVC.

The base assembly 3 comprises an upper section 5 and a lower section 7. The upper section 5 is configured to provide an anchoring point for an object, whereas the lower section is configured to secure the base assembly 3 in the ground. In the present embodiment, the upper 5 and lower 7 sections are separate members secured to one another, however it is appreciated that in other embodiments, the base assembly 3 can be formed from a single piece, and upper 5 and lower 7 sections can be parts of a unitary body.

Upper 5 and lower 7 sections are correspondingly-shaped cylinders which can be assembled with one another to form the cylindrical-shaped base assembly 3. More specifically, upper 5 and lower 7 sections assemble with one another in an end-to-end configuration, together defining a height 9 of the base assembly 3. Preferably, upper 5 and lower 7 sections are removably engageable with one another. As can be appreciated, in this configuration, upper section 5 can be removed from lower section 7, providing access to an interior of the base assembly 3. Preferably still, upper 5 and lower 7 sections are adjustably secured with one another, allowing to adjust how closely they engage, and thus allowing to adjust the overall height 9 of base assembly.

Figure 3B:
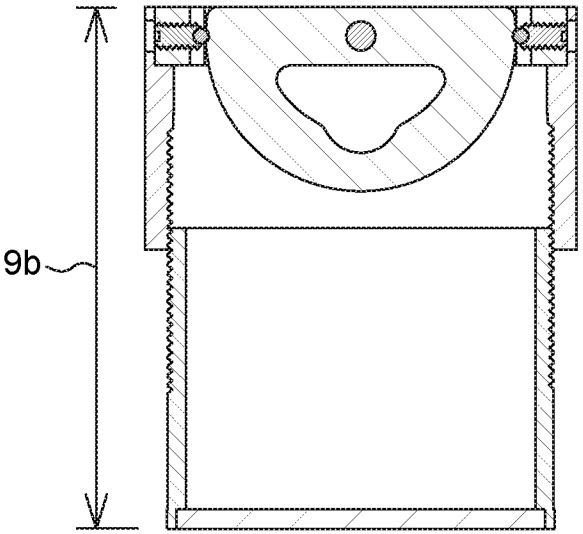
FIGS. 3A and 3B are cross sectional views of the anchor system of FIG. 1A, showing height adjustment via threaded connections of the upper and lower sections of base assembly.
Figure 3A:
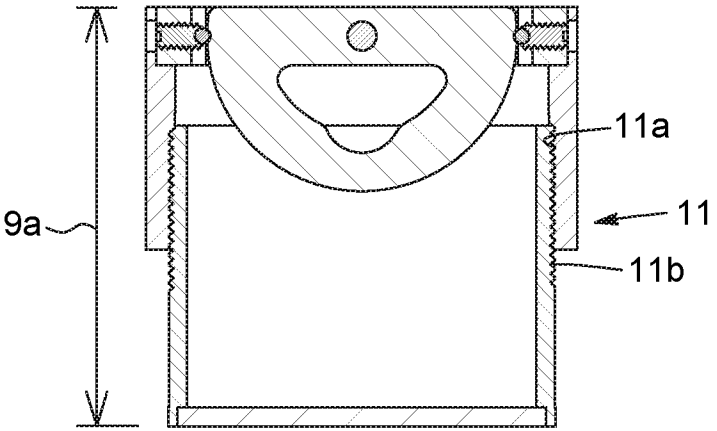
Figure 4A:
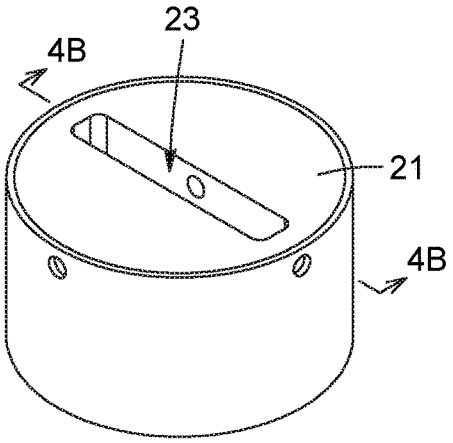
FIG. 4A is a perspective view of the top section of the base assembly, according to an embodiment.
Figure 4B:
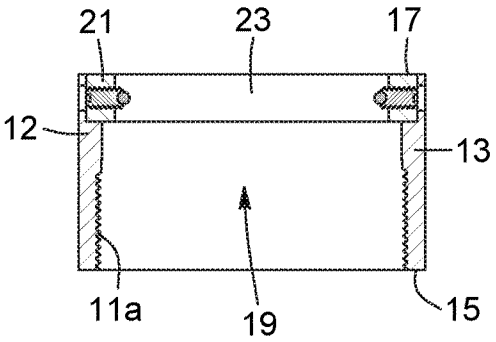
FIG. 4B is a cross sectional view thereof.
Figure 5A:
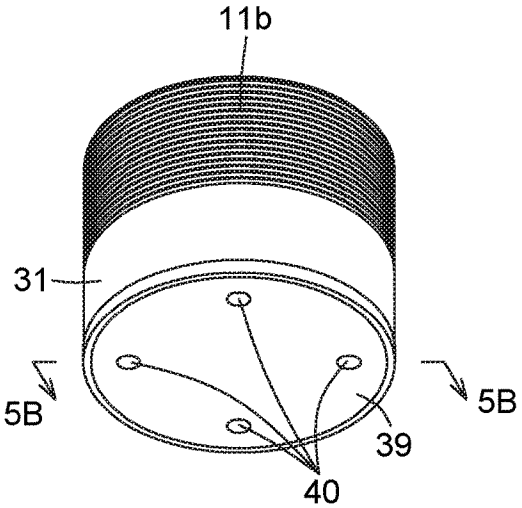
FIG. 5A is a perspective view of the bottom section of the base assembly, according to an embodiment.
Figure 5B:
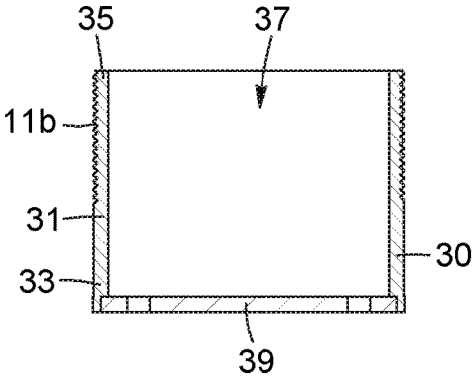
FIG. 5B is a cross sectional view thereof.

In the present embodiment, upper 5 and lower 7 sections are removably and adjustably securable to one another via a threaded connection 11. As best illustrated in FIGS. 3A and 3B, upper section 5 is configured to fit over lower section 7, and to secure to an end thereof via threads 11. As shown in FIG. 3A, as upper section 5 and lower section 7 are pivoted clockwise relative to one another, the threads 11 engaged to draw upper 5 and lower 7 sections closer together, thereby configuring the base assembly 3 with a reduced height 9*a*. As shown in FIG. 3B, when pivoted (or rotated) counter-clockwise relative to one another, upper 5 and lower 7 sections are spaced apart, thus configuring the base assembly 3 with an increased height 9*b*. Continuing to rotate the section 5, 7 counter-clockwise can allow for the threads 11 to disengaged, allowing the upper 5 and lower 7 sections to be separated from one another.

Figure 15:
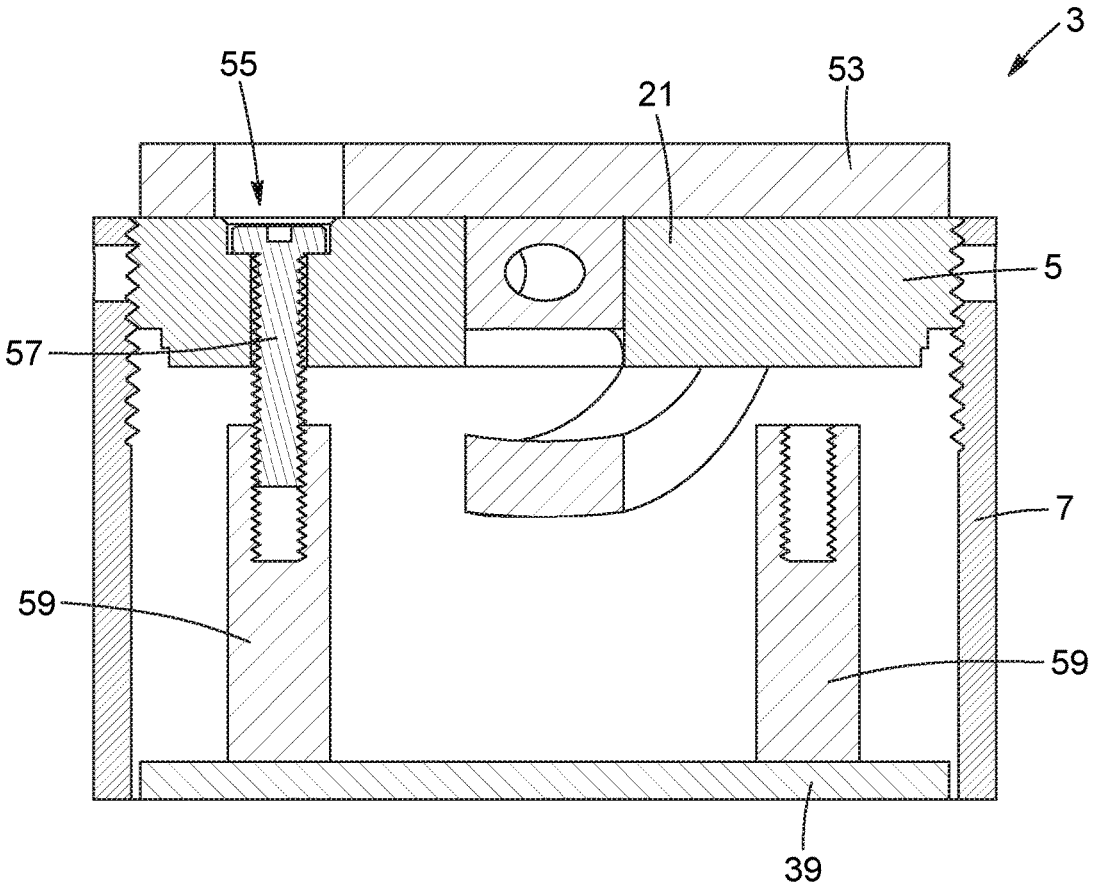
FIG. 15 is a cross sectional view of the anchor system of FIGS. 9 and 10, showing the locking bolt engaging the top and bottom sections.

Although a particular configuration of a threaded connection 11 between upper 5 and lower 7 sections has been described, it is appreciated that other configurations are also possible. For example, in some embodiments, and as will be described in more detail later on, the upper section 5 can be configured to fit inside the lower section 7. Moreover, the size, orientation and configuration of the threads 11 can vary. In some embodiments, a stop can be provided to limit relative movements of the upper 5 and lower 7 sections, for example to set a minimum and/or maximum adjustable height of the base assembly 3, and/or to prevent upper 5 and lower 7 sections from being fully disengaged. In some embodiments, a locking mechanism can be provided to lock upper 5 and lower 7 sections together in their current configuration, and prevent adjustment of the upper 5 and lower 7 sections until the lock is disengaged. For example, as illustrated in FIG. 15, a locking bolt 57 can be inserted through a corresponding aperture 55 in upper section 5, and said locking bolt 57 can be received in a corresponding bolt engagement member 59 in bottom section 7, thereby preventing further adjustment of upper 5 and lower 7 sections, and preventing upper section 5 from being disengaged from lower section 7. As can be appreciated, a plurality of engagement members 59 can be provided such that the locking bolt 57 can be engaged when the upper section 5 is in different positions relative to the lower section 7. Preferably, locking bolt 57 is a security bolt, and is shaped and configured to be engaged/disengaged by a tool keyed specifically to engage with the bolt. It is appreciated that other locking mechanisms are possible as well.

Although in the present embodiment the adjustable engagement of upper 5 and lower 7 sections is achieved via a threaded connection 11, it is appreciated that other mechanisms are also possible. For example, upper 5 and lower 7 sections can be slidably engaged with one another and/or can be connected via an adjustable hydraulic element. Preferably, the adjustable connection allows for the height 9 of base assembly 3 to be adjusted over a continuous range of values, and thus allows for very minor adjustments in the height 9 of the base assembly 3. However, it is appreciated that other adjustable engagements can allow for the height 9 to be adjusted between discrete values. For example, upper 5 and lower 7 section can be engaged via a lock-and-turn mechanism, or by a screwed-in rod mechanism.

In the present embodiment, upper 5 and lower 7 sections cooperate in order to provide a base assembly 3 which can be securely installed in the ground and which can provide an interface for anchoring objects thereto. More specifically, lower section 7 serves to secure base assembly 3 to the ground, while upper section 5 serves to allow objects to be anchored to the base assembly 3.

In more detail now, and with reference to FIGS. 1A to 2B and 4A to 5B, upper section 5 has a body 12 comprising peripheral wall 13 extending between a lower end 15 and an upper end 17, and defining an interior space 19. The upper section 5 is open at its lower end 15 for receiving an end of the lower section 7 therein, and has threads 11*a* on an inner surface of its peripheral walls 13 for engaging with corresponding threads in the lower section 7. The upper end 17 is closed via a cap 21 having an aperture 23 formed therein. Cap 21 is planar, and is positioned to define a flat top surface 25 on the base assembly 3. Preferably, cap 21 is permanently secured to the peripheral walls 13. For example, in the present embodiment, cap 21 is welded to peripheral walls 13. However, it is appreciated that in other embodiments, cap 21 can be removably engaged with peripheral walls 13. In other embodiments, cap 21 can be integrally formed as part of the body 12.

An anchoring mechanism is provided in upper section 5 to allow an object to be anchored thereto. In the present embodiment, the anchoring mechanism comprises an anchoring member 100 configured to act as an interface and/or a tiedown point for securing an object. For example, in the present embodiment, the anchoring member 100 is configured as a closed loop, providing an anchoring point allowing an object to be tied thereto, either directly or via tethering mechanism such as a cable, leash, lock etc. Where a tethering mechanism is used, the tethering mechanism can be threaded through anchoring member 100 and around object. First and second ends of the tethering mechanism can subsequently be secured together, for example via a lock, in order to for a closed loop and secure the object to the base assembly 3. The tethering mechanism and/or lock and be sold as a kit along with base assembly 3. It is appreciated that other configurations of the anchoring member 100 are also possible, so long as it provides a mechanism to which objects can be secured.

Preferably, the anchoring mechanism is retractable. In other words, the anchoring member 100 is preferably configurable in an operating configuration 100*a* in which the anchoring point is exposed, and in a retracted configuration 100*b* in which the anchoring point is substantially concealed. In the present embodiment, the anchoring member 100 is movable between the operating configuration 100*a* and the retracted configuration 100*b*. In the operating configuration 100*a*, an operative side of anchoring member 100 extends substantially above the top cap 21. In the retracted configuration, the operative side of anchoring member 100 extends substantially below the top cap 21, and the anchoring member 100 preferably forms the top flat surface 25 of the base assembly 3 together with the top cap 21. As can be appreciated, in the operating configuration 100*a*, the anchoring member 100 is exposed on an exterior of the base assembly 3, thus allowing objects to be secured thereto. In the retracted configuration 100*b*, the anchoring member 100 is substantially concealed inside the base assembly 3, preventing objects from being secured thereto. Although in the present embodiment the anchoring member 100 is movable, it is appreciated that other configurations are possible to allow for the anchoring member 100 to be retracted. For example, the anchoring member 100 can be stationary, and other components of the base assembly 3 can be moved around the anchoring member 100 to conceal the same.

Figure 13A:
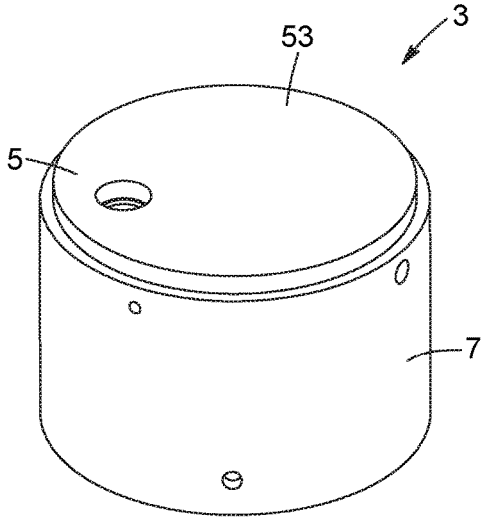
FIG. 13A is a perspective view of an anchor system according to an alternate embodiment in which the anchor member is retracted by inverting the top section, shown in the retracted configuration.
Figure 14A:
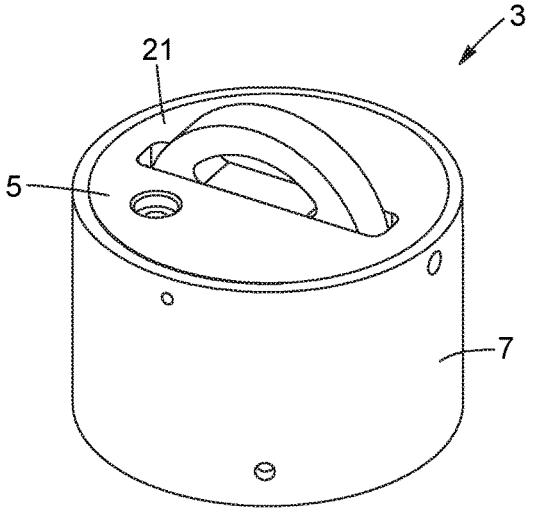
FIG. 14A is a perspective view of the anchor system of FIG. 13, show in the operating configuration.
Figure 13B:
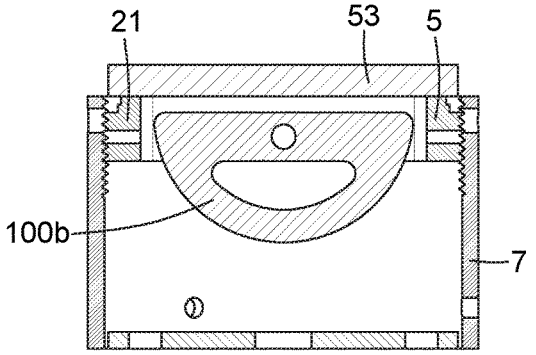
FIG. 13B is a cross sectional view thereof.
Figure 14B:
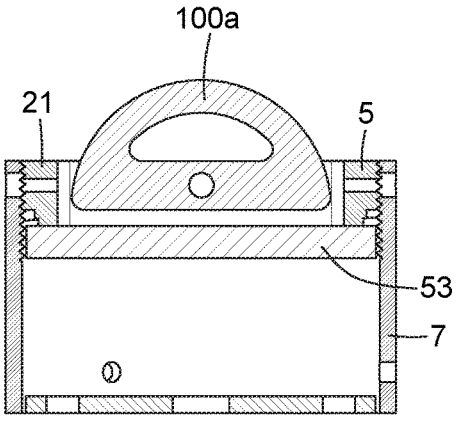
FIG. 14B is a cross sectional view thereof.

In the present embodiment, the anchoring member 100 is pivotally secured to the upper section 5 of base assembly 3 via a pin 27 (best shown in FIG. 2B), and is positioned to pivot through aperture 23 in top cap 21. In this configuration, the anchoring member 100 can be pivoted around pin 27 between the operating 100*a* and retracted 100*b* configurations via a pivoting motion. However, it is appreciated that in other embodiments, anchoring member 100 can be retracted in different fashions. For example, when a smaller base assembly 3 is required, it may not be practical to have a moving anchoring member 100. In such embodiments, anchoring member 100 can be fixed to top cap 21 and/or formed as part of top cap 21, and anchoring member 100 can be retracted by pivoting or rotating top cap 21. An exemplary embodiment of such a configuration is shown in FIGS. 13A, 13B, 14A, and 14B. More specifically, as shown in FIGS. 13A and 13B, anchoring member 100 is fixed to top cap 21, and extends from a bottom side thereof. Preferably, a cover 53, such as a cushion, is provided on the top side of the top cap 21. In this configuration, anchoring member 100 is in a retracted configuration 100*b* by being concealed within the base assembly 3 and cover 53 is exposed at the top of the base assembly 3, defining the top flat surface 25. As shown in FIGS. 14A and 14B, top cap 21 can be completely removed from lower section 7 by unscrewing it. Top cap 21 can then be flipped over and screwed back in to lower section 7. In this configuration, cover 53 is now concealed within the base assembly 3, whereas anchoring member 100 is in an operating configuration 100*a*, exposed at the top of base assembly.

Figure 6:
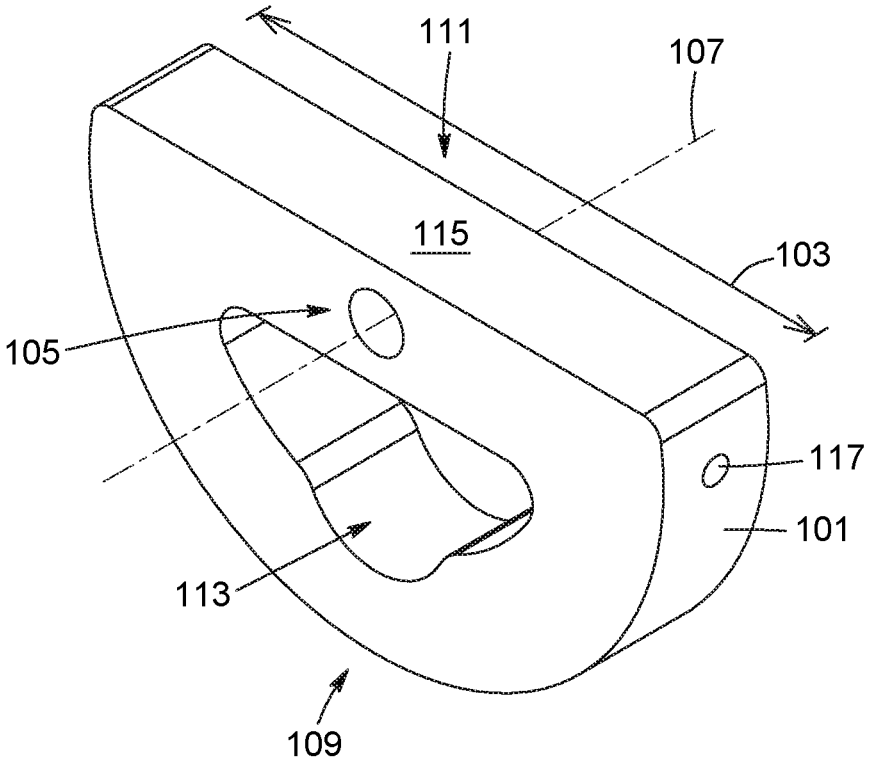
FIG. 6 is an individual perspective view of an anchoring member, according to an embodiment.

Returning now to the embodiments of FIGS. 1A to 2B and 4A to 5B, and with reference to FIG. 3, anchoring member 100 comprises a solid body 101 extending along a length 103. A pin aperture 105 extends through the body 101 for receiving pin 27 therethrough, defining a pivot axis 107 extending perpendicular to length 103. The body 101 is configured with an operative side 109 and a passive side 111 positioned on opposite sides of the pivot axis 107. The operative side 109 comprises an attachment interface for allowing objects to be attached or anchored thereto. In the present embodiment, body 101 comprises a central aperture 113 with a plurality of lobes. In this configuration, the body 101 forms a closed loop, and has an arc or semi-circular shape, and is thus a suitable interface onto which attachment mechanisms can be tied or locked. The passive side 111 comprises a flat surface 115, which is preferably complementary in shape with aperture 23 in top cap 21. Although a particular configuration of the anchoring member 100 is described herein, it is appreciated that As can be appreciated, in the above-described configuration, the anchoring member 100 can be pivoted through 180° about its pivot axis 107 to move between the operating configuration 100*a* and the retracted configuration 100*b*. With reference to FIGS. 1A to 2B in addition to FIG. 6, in the retracted configuration 100*b*, the operative side 109 faces downwards and extends in interior space 19 below top cap 21. The passive side 111 faces upwards, with flat surface 115 being coplanar with top cap 21. The flat surface 115 substantially covers aperture 23, and preferably forms therewith the top flat surface 25 of base assembly 3. A user can push down on an extremity of the flat surface 115 to pivot anchoring member 100 about pivot axis 107 and through aperture 23. When pivoted through 180°, the passive side 111 faces downwards, while operative side 109 faces upwards and is exposed on the exterior of base assembly 3.

Preferably, anchoring member 100 is shaped so that it can pivot unobstructed through aperture 23 in either direction. For example, in the present embodiment, anchoring member 100 has a substantially semi-circular shape defined by the flat passive side 111 and a rounded operative side 109. In the present embodiment, the operative side 109 has a radius selected such that there is minimal clearance between the body 101 and the edges of cap aperture 23 as the anchoring member 100 is pivoted. It is appreciated, however, that different shapes and sizes of anchoring member 100 are also possible, so long as it can pivot unobstructed. In some embodiments, anchoring member 100 can be shaped or configured such that it can pivot only in a predetermined direction.

Preferably still, a retaining element is provided for retaining the anchoring member 100 in the operating 100*a* and/or retracted 100*b* configurations. For example, in the present embodiment, bearings 29 are provided in cap 21 and extend inward at both extremities of aperture 23. Corresponding notches 117 are provided on opposite sides of the body 101 of anchoring member 100, in plane with the pivot axis 107.

In this configuration, when in the operating 100*a* and/or retracted 100*b* configurations, bearings 29 engage in notches 117 to retain the anchoring member 100 in its current configuration. To pivot anchoring member 100, a user will be required to provide additional force to disengage bearings 29.

Although a particular pivoting configuration of anchoring member 100 is described above, it is appreciated that other configurations are also possible. For example, instead of pivoting about an axis perpendicular to length 103, it could pivot about an axis parallel to length 103. In some embodiments, instead of pivoting to extend inside base assembly 3, anchoring member 100 can be pivoted to lie flat on a recess in cap 21.

Moreover, although the retracting functionality of anchoring member 100 was described herein in connection with a pivoting element, it is appreciated that other configurations are also possible to allow anchoring member 100 to be retracted. For example, in an embodiment, anchoring member 100 can be fixed to base assembly 3, either inside the top section 5 or the lower section 7. The top cap 21 can be removable, for example, via a threaded connection, magnetic connection, interference fit, etc. Cap 21 can be removed to expose anchoring member 100 in the operating configuration 100*a*, and reattached to conceal anchoring member 100 within the base assembly 3 in the retracted configuration 100*b*.

In the present embodiment, lower section 7 is configured for securing the base assembly 3 in the ground. In more detail now, and with reference to FIGS. 1A to 2B and 4A to 5B, lower section 7 has a body 30 comprising peripheral walls 31 extending between a lower end 33 and an upper end 35. In the present embodiment, the peripheral walls 31 define a hollow interior space 37, although it is appreciated that in other embodiments the body of lower section 7 can be solid. The lower section 7 is open at its upper end 35 for providing access to the interior space 37, and is configured for fitting in a corresponding end of the upper section 5. It is appreciated, however that in some embodiments, the upper end 35 can be closed. Threads 11*b* are provided on an exterior surface of the peripheral walls 31 for engaging with corresponding threads in the upper section 5. The lower end 33 is closed via a cap 39 having a plurality of fastener apertures 40 formed therein. Cap 39 is planar, and can serve as a mounting plate. Preferably, cap 39 is permanently secured to the peripheral walls 31. For example, in the present embodiment, cap 39 is welded to peripheral walls 31. However, it is appreciated that in other embodiments, cap 39 can be removably engaged with peripheral walls 31. In other embodiments, cap 39 can be integrally formed as part of the body 30.

Figure 7:
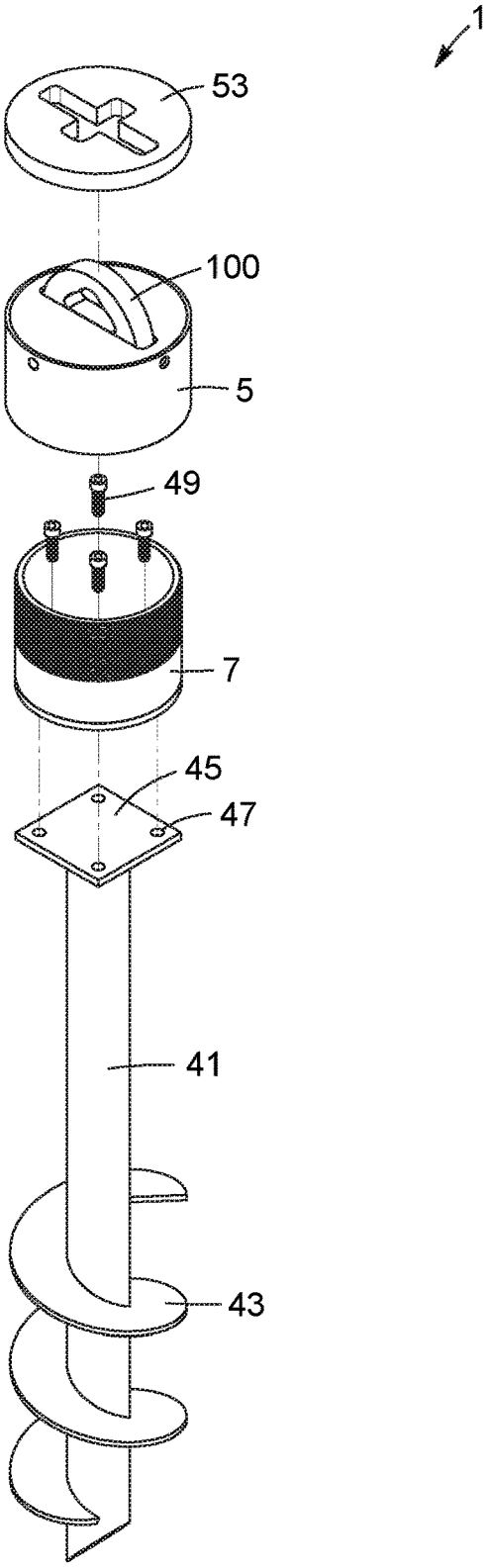
FIG. 7 is an exploded view of the anchor system, according to an embodiment.

Preferably, a ground securing mechanism is provided in lower section 7 to more stably secure base assembly 3 in the ground. With reference to FIG. 7, in the present embodiment, ground securing mechanism comprises a pile (or stake) 41 securable to the cap 39 of lower section 7. At one end of the pile 41 is an auger member 43 to help drive the pile 41 into the ground. Opposite the auger members 43 is a mounting plate 45 for mounting to the cap 39. In the present embodiment, mounting plate 45 comprises apertures 47 for aligning with apertures 40 of cap, and receiving fasteners, such as screws or bolts, therethrough. It is appreciated that in other embodiments, the auger member 41 can be fastened to lower 7 section using other means. For example, auger member 41 can be welded to the lower section 7. Although in the present embodiment the pile 41 is fastened to cap 39, it is appreciated that in other embodiments, the pile 41 can be integrally formed as part of the cap 39 and/or body 30 of the lower section 7. Moreover, although the ground securing mechanism in the present embodiment is a pile 41, it is appreciated that other ground securing mechanisms are also possible. For example, the ground securing mechanism can comprise a cement base. Finally, although a particular configuration of apertures 40 is shown, it is appreciated that other configurations of apertures 40 can also be provided. For example, a single central aperture can be provided for interfacing with a corresponding type of auger member.

Figure 8:
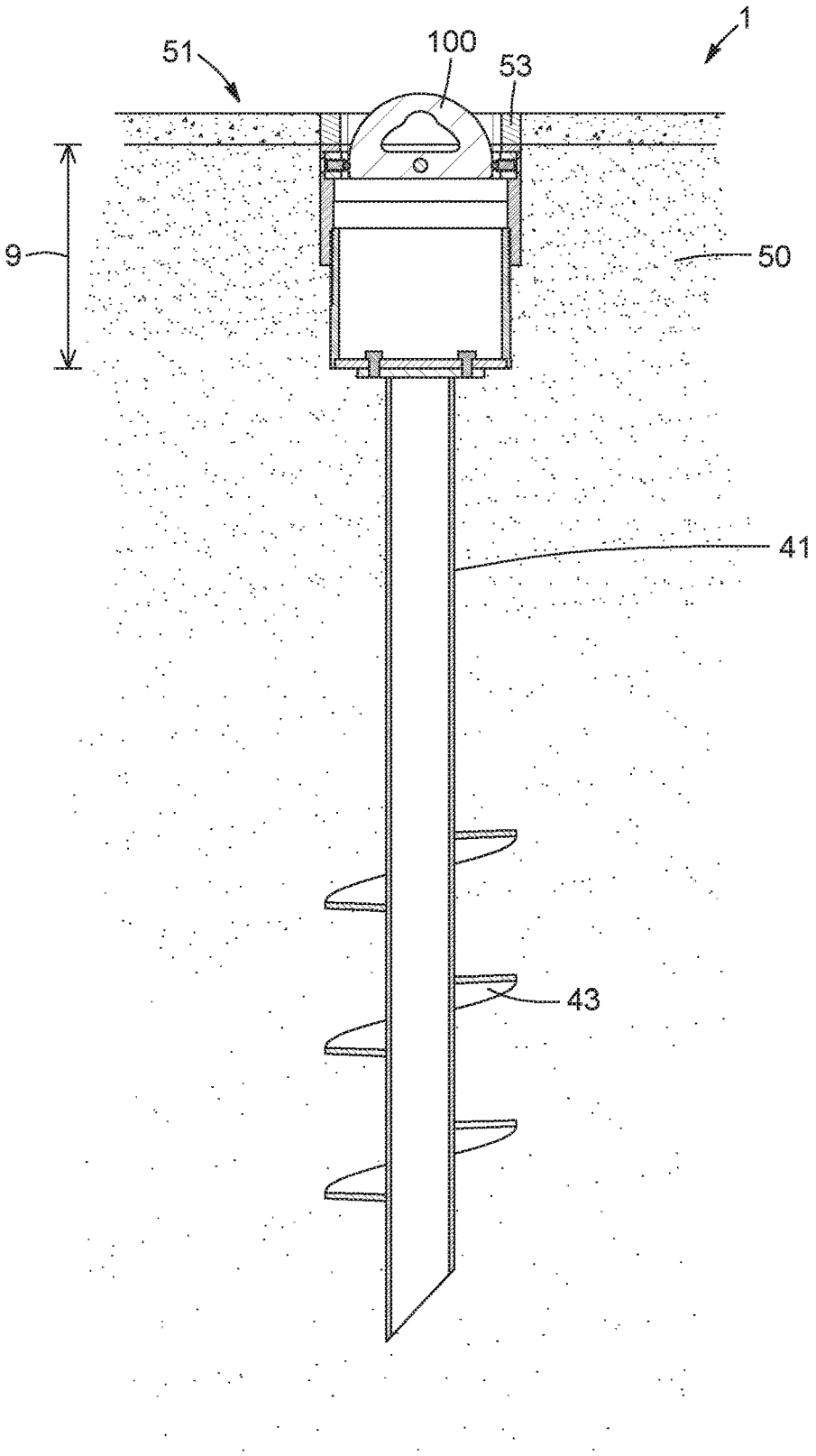
FIG. 8 is a cross sectional view showing the anchor system of FIG. 7 in an installed configuration.
Figure 9A:
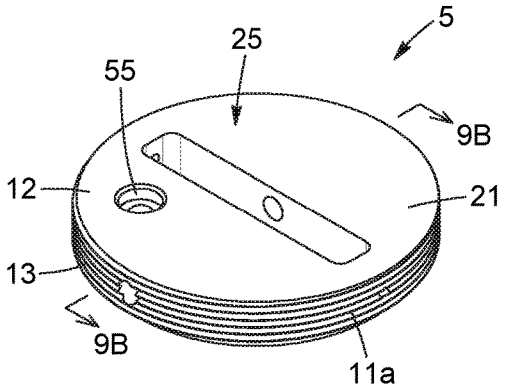
FIG. 9A is a perspective view of the top section of an anchor system according to an alternate embodiment in which the top section has threads on its outer sidewalls for engaging with the bottom section.
Figure 9B:
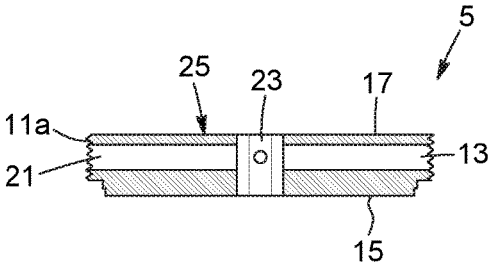
FIG. 9B is a cross sectional view thereof.
Figure 10A:
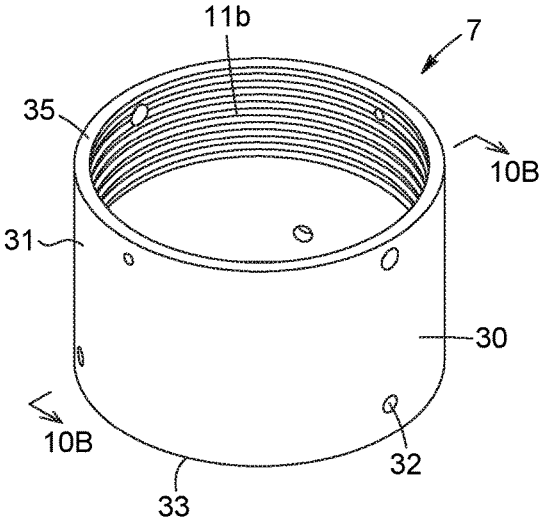
FIG. 10A is a perspective view of the bottom section of an anchor system according to an alternate embodiment in which the bottom section has threads on its inner sidewalls for engaging with the top section.
Figure 10B:
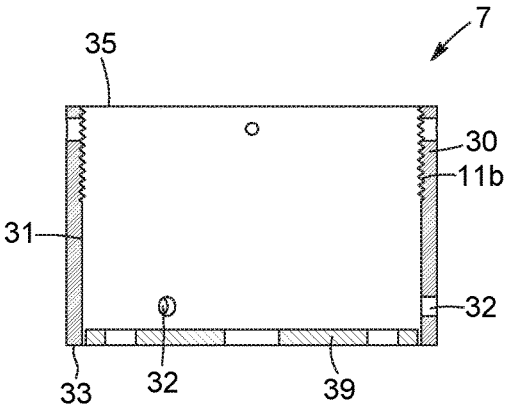
FIG. 10B is a cross sectional view thereof.

As can be appreciated, the above-described anchor system 1 can be installed in the ground and can act as an anchoring point for objects. With reference to FIGS. 7 to 8, in an installed configuration, base assembly 3 is buried in ground 50 with top surface 25 exposed. Anchoring member 100 can be configured to extend from the top surface 25, allowing an object, such as a fabric enclosure, mobile home, airplane, sporting equipment, industrial equipment, etc., to be anchored thereto. In some embodiments, the object can be anchored using a holding mechanism comprising a leash, such as a plastic or vinyl-coated steel cable with looped ends, and lock, such as a padlock. It is appreciated that in other embodiments, other holding mechanisms can be used, and/or the object can be anchored directly to anchoring member 100. It is also appreciated that objects other than those listed above can be anchored.

Preferably, the top surface 25 of the base assembly 3 is aligned with the ground surface 51 to form a planar surface therewith. In the present embodiment, the top surface 25 is defined by a cover 53 covering the top cap 21 of the base assembly 3. The cover 53 can be made, for example, from materials such as wood, plastic, rubber, etc. The cover 53 can further be configured to have a cushioned surface, a painted and/or colored surface, etc. The cover 53 can further be configured to have water repellant properties, absorbent properties, and/or can be made of porous or non-porous material. The cover 53 is permanently adhered to top cap 21, and includes a central opening to receive anchoring member 100 therethrough. Preferably, the central opening is shaped to allow the anchoring member 100 to pivot therethrough unobstructed, and is preferably shaped to correspond to the aperture 23 formed in cap 21. In the present embodiment, the central opening of cover 53 extends along a length, and comprises lobes extending perpendicular to the length, thereby defining a cross-shape. As can be appreciated, the lobes can provide additional clearance for cables, tether or fastening mechanisms threaded through anchoring member 100. In some embodiments, cover 53 can include a movable flap to cover its central opening when anchoring member 100 is retracted. In other embodiments, cover 53 can be removably attached to top cap 21, and/or can be configured without a central opening such that it completely covers top cap 21 when anchoring member 100 is retracted. In some embodiments, cover 53 can have other openings, for example to provide access to aperture 55 for engaging locking bolt 57. Although in the present embodiment the top surface 25 is defined by cover 53, it is appreciated that in some embodiments, base assembly 3 can be provided without a cover 53, and that top surface 25 can be defined by the top cap 21 of the base assembly 3.

As can be appreciated, in the present embodiment, top cap 21 is made from metal, and it is not always desirable that the metallic top cap 21 be exposed on the ground surface 51 when the base assembly 3 is installed in the ground 50. Providing cover 53 allows selecting a more appropriate material to be exposed on the ground surface 51. For example, the cover 53 can be made of the same or similar material as the surrounding ground surface, thus better blending the top surface 25 in the surrounding ground surface 51. In some embodiments, the cover 53 can have the same color of the ground surface 51 to better camouflage the anchor system 1, whereas in other embodiments the color can be contrasted with that of the ground surface 51 to allow for the anchor system 1 to stand out visually. Providing a cover 53 can also aid in better aligning the top surface 25 with the ground surface 51, can provide cushioning on the top cap 21 of the base assembly 3, can seal the base assembly 3 from the elements and/or can provide absorbent properties above the base assembly 3. In some embodiments, it may be desirable for the top cap 21 to be exposed directly on the ground surface 51. In such embodiments, the base assembly 3 can be provided without cover 53, and the top cap 21 can be aligned with the ground surface 51.

Advantageously, the above-described anchor system 1 can be easily adjusted after installed. For example, installing the anchor system can comprise the steps of digging a hole in the ground to a depth corresponding to an approximate height of the base assembly 3; driving the pile 41 into the ground 50; securing the lower section 7 of base assembly 3 to the pile; securing the upper section 5 of the base assembly 3 to the lower section 7; and filing in the ground 50 surrounding the base assembly 3 while leaving the top surface 25 exposed. The height 9 of base assembly 3 can be adjusted thereafter, for example by screwing or unscrewing upper 5 and lower section 7, in order to bring top surface 25 in alignment with the ground surface 51. As can be appreciated, height 9 can be adjusted at any time after installation in order to bring top surface 25 back in alignment with the ground surface 51, such as in the event ground surface 51 has sunk, for example due to settlement of ground 50 surrounding the base assembly, and/or in the event ground surface 51 rises, for example due to plants growing in the ground 50.

Although several steps for installing the anchor system 1 were described above, it is appreciated that the steps can vary in other embodiments. For example, steps can vary according to the type of ground in which the anchor system 1 is installed, depending on whether the anchor system 1 requires more or less support, and/or whether anchor system 1 needs to be protected. For example, in some embodiments, ground 50 surrounding base assembly 3 can be compacted to provide a more stable support. In some embodiments, the base assembly 3 can be embedded in concrete. In some embodiments, base assembly 3 can be secured in the ground 50 without a pile 41. In some embodiments, base assembly 3 can be wrapped in a protective sleeve, such as a sleeve made from rubber, plastic, vinyl, and/or other protective material.

Although a particular configuration of base assembly 3 was described above, it is appreciated that other configurations are also possible, and that additional features/components can be provided. For example, with reference to FIGS. 9A, 9B, 10A, and 10B, base assembly 3 is shown according to an alternate embodiment in which upper section 5 is configured to fit inside lower section 7. This embodiment of base assembly 3 also demonstrates a different type of ground securing mechanism which can be used in different embodiments of base assembly 3.

More specifically, in the present embodiment, upper section 5 has a substantially cylindrical-shaped body 12 defined by peripheral walls 13 extending between a lower end 15 and an upper end 17. In this embodiment, body 12 is a solid piece of metal, and does not have an interior space. Peripheral walls 13 comprise an outer surface having threads 11*a* formed therein for engaging with corresponding threads in lower section 7. In this embodiment, the height of body 12 is selected such that body 12 resembles a disk. However, it is appreciated that body 12 can have different height in other embodiments, and correspond to a more elongated cylinder. Body 12 further has an aperture 55 defined therein which opens on top 25 and bottom surfaces 26, for receiving a locking/security bolt as described previously.

Lower section 7 has a substantially cylindrical-shaped body 30 comprising peripheral walls 31 extending between a lower end 33 and an upper end 35 and defining a hollow interior space 37. Lower section 7 is open at its upper end 35 for providing access to interior space 37, and is configured for receiving upper section 5 therein. The lower end 33 is closed via a cap 39. The peripheral walls 31 comprise outer and inner surfaces, with the inner surface having threads 11*b* formed therein for engaging with the threads 11*a* in upper section. Peripheral walls 31 further comprise a plurality of fastener apertures 32 formed therein. In the present embodiment, three apertures 32 are spaced apart and extend peripherally along sidewalls 31, adjacent the lower end 33. The apertures extend through sidewalls 31, and open on the inner and outer surfaces thereof. It is appreciated however, that a different number and configuration of apertures are possible in other embodiments.

Figure 11A:
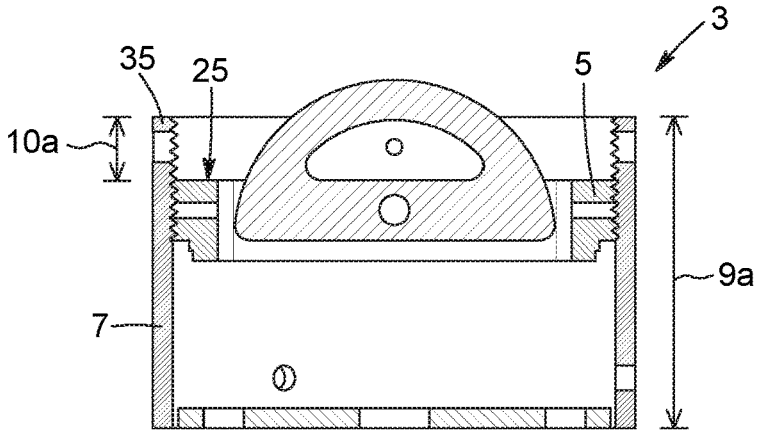
FIGS. 11A, 11B and 11C are cross sectional views of the anchor system of FIGS. 9 and 10, showing height adjustment via threaded connections of the upper and lower sections of base assembly.
Figure 11B:
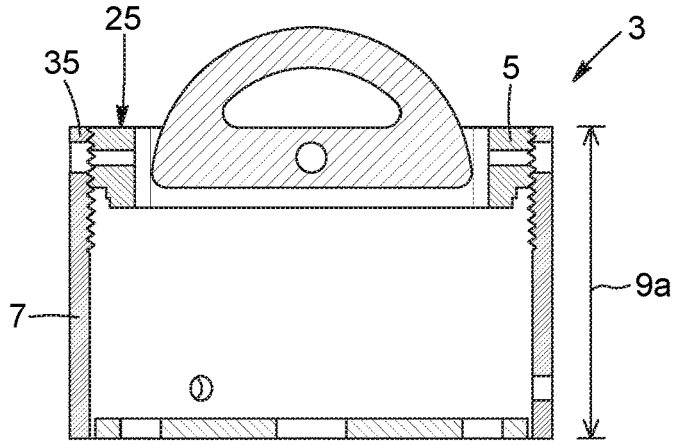
Figure 11C:
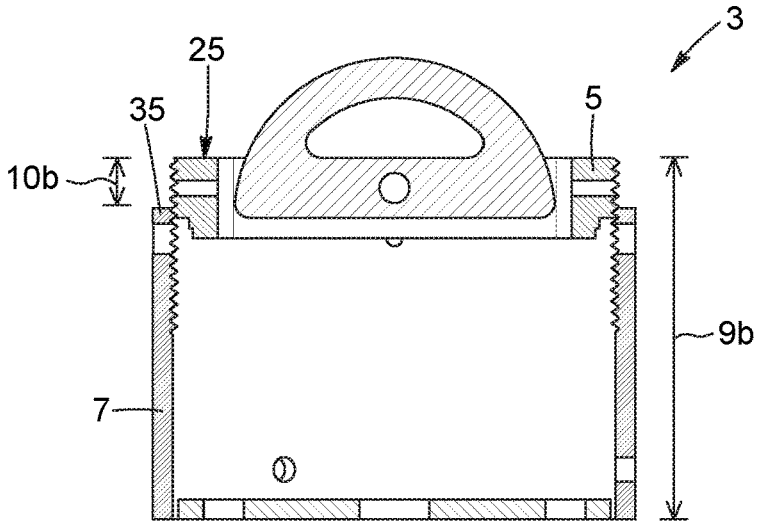

As can be appreciated, the present configuration can allow for an overall height of the base assembly 3 to be adjusted, and can further allow to adjust an offset of top surface 25. With reference to FIGS. 11A, 11B, and 11C, the overall height 9 of the base assembly 3, and/or the offset of top surface 25 can be adjusted by pivoting upper 5 and lower 7 sections relative to one another. As shown in FIG. 11A, upper section 5 can be adjusted such that it extends below upper end 35 of lower section 7. In this configuration, top surface 25 of upper section 5 is offset below upper end 35 by a distance 10*a* which can, for example, serve to accommodate a cover/cushion 53, for example to allow a top surface of cover/cushion 53 to be substantially flush with upper end 35. In this configuration, the height 9*a* corresponds to a height of lower section 7. As shown in FIG. 11B, upper section 5 can further be adjusted such that top surface 25 of upper section 5 is flush with upper end 35 of lower section 7. Finally, as shown in FIG. 11C, upper section 5 can be adjusted such that top surface 25 extends above upper end 35 of lower section 7 and is offset therefrom by distance 10*b*, thus defining an increased overall height 9*b* of the base assembly 3.

Figure 12:
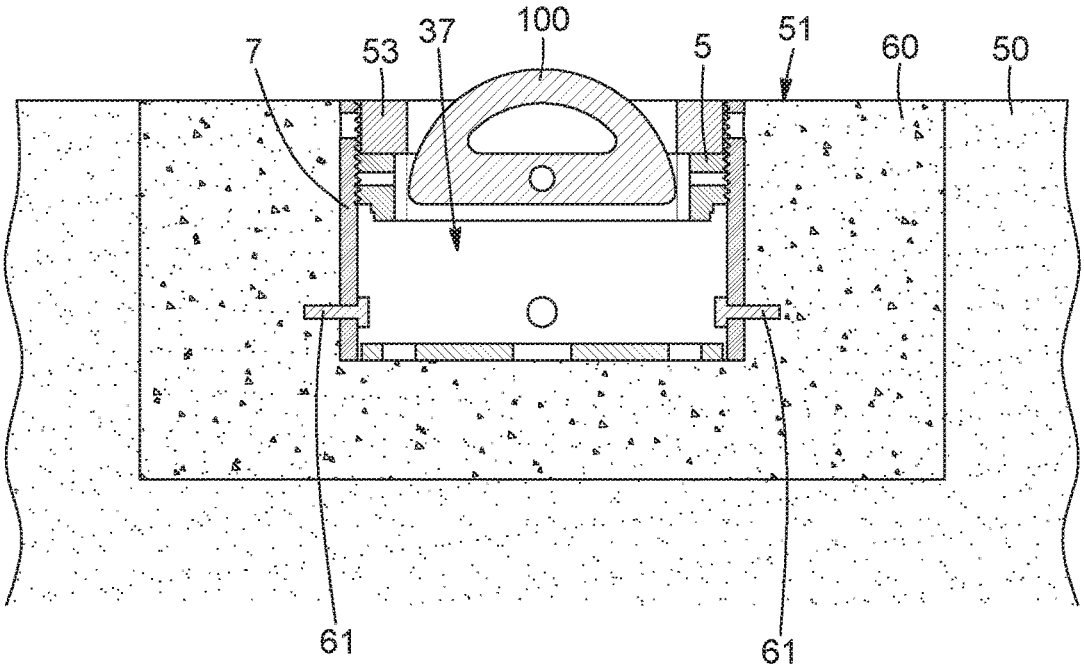
FIG. 12 is a cross sectional view showing the anchor system of FIGS. 9 and 10 in an installed configuration.

As can be appreciated, the present embodiment of base assembly 3 can be suitable for installing in concrete footings in the ground. Lower section 7 can be installed in a preformed hole in concrete, and upper section 5 can be adjusted as needed inside the lower section 7 without being interfered by surrounding concrete. With reference to FIG. 12, the base assembly 3 is shown in an installed configuration in a concrete footing 60 in the ground 50. Lower section 7 is installed in the concrete and secured therein via fasteners 61, such as bolts, which extend through fastener apertures 32 and into concrete 60. As can be appreciated, fasteners 61 can be installed through the hollow interior space 37 in lower section 7, before being closed by engaging upper section 5. In the illustrated configuration, cover/cushion 53 is secured to top surface 25 of upper section 5, and upper section 5 is adjusted to be offset such that the top surface of cover/cushion 52 is substantially flush with the top surface 51 of the surrounding concrete 60 and/or ground 50. It is appreciated that other configurations are possible as well.

The described configurations are but some possible embodiments for the anchor system and corresponding installation methods. Although not explicitly mentioned, other useful embodiments or configurations may be apparent to one skilled in the art upon reading the present disclosure. Additionally, although some advantages have been described herein, other advantages may become apparent to one skilled in the art upon reading the present disclosure.

The invention claimed is:

1. An anchor system for anchoring an object, the anchor system comprising:

a base assembly having sidewalls defining a hollow interior, the base assembly comprising a lower section, and an upper section having a substantially planar top surface, said upper section being adjustably secured to the lower section for adjusting an overall height of the base assembly; and a retractable anchoring member comprising an anchoring point, the retractable anchoring member being pivotally secured to the upper section and being pivotable about a pivot axis parallel to the top surface between an operating position in which the anchoring point extends above the top surface of the upper section, and a retracted configuration in which the anchoring point extends in the hollow interior of the base assembly and is concealed below the top surface of the upper section.

2. The anchor system according to claim 1, wherein the upper section is adjustably secured to the lower section via a threaded connection, and the overall height of the base assembly is adjustable by pivoting the upper section relative to the lower section.

3. The anchor system according to claim 2, wherein the lower section comprises a hollow cylindrical body defined by peripheral sidewalls having inner and outer surfaces, further wherein the inner surface of the peripheral sidewalls comprises threads for engaging with corresponding threads in the upper section.

4. The anchor system according to claim 3, wherein the upper section comprises a substantially cylindrical-shaped body defined by sidewalls having an outer surface, further wherein the outer surface of the sidewalls of the upper section comprises threads for engaging with the corresponding threads on the inner surface of the sidewalls in the lower section.

5. The anchor system according to claim 2, wherein the lower section comprises a substantially cylindrical-shaped body defined by peripheral sidewalls having an outer surface, wherein the upper section comprises a hollow cylindrical body defined by peripheral sidewalls having inner and outer surfaces, and wherein the outer surface of the peripheral sidewalls of the lower section comprises threads for engaging with corresponding threads on the inner surface of the peripheral sidewalls of the upper section.

6. The anchor system according to claim 1, further comprising a locking mechanism engageable to secure the upper and lower sections in a current relative position, the locking mechanism preventing subsequent adjustment of the upper and lower sections when engaged to lock the overall height of the base assembly.

7. The anchor system according to claim 6, wherein the locking mechanism comprises a locking bolt engageable in a corresponding aperture on the top surface of the upper section of the base assembly.

8. The anchor system according to claim 1, wherein the retractable anchoring member is pivotable between the operating position in which the anchoring member protrudes from the upper section, and the retracted configuration in which the anchoring member is flush with the planar top surface of the upper section.

9. The anchor system according to claim 1, further comprising a pile member extending from the lower section of the base assembly for securing the lower section in the ground.

10. The anchor system according to claim 1, wherein the lower section of the base assembly comprises a bottom cap and sidewalls together defining a hollow interior with an open top, wherein the upper section is engageable with the lower section to close the open top, wherein the top section is removable from the lower section to provide access to the hollow interior, and wherein at least one of the bottom cap and the sidewalls have apertures defined therein for receiving fasteners to secure the lower section to a pile member or a concrete footing in the ground.

11. An anchor system for anchoring an object, the anchor system comprising:

a base assembly, the base assembly comprising a body having a substantially planar top surface and sidewalls defining a hollow interior; and an anchoring member pivotally secured to the base assembly for anchoring the object to the base assembly, said anchoring member comprising an anchoring point and being pivotable about a pivot axis parallel to the planar top surface between a retracted position in which the anchoring member is flush with the top surface of the base assembly and the anchoring point extends in the hollow interior of the base assembly, and an operating position in which the anchoring member protrudes from the top surface of the base assembly and the anchoring point extends above the top surface of the base assembly.

12. The anchor system according to claim 11, wherein the anchoring member comprises a body extending along a length, further wherein the pivot axis extends substantially perpendicular to said length and substantially bisects the length of the body.

13. The anchor system according to claim 12, wherein the body of the anchoring member comprises a passive side opposite an operative side, further wherein the pivot axis extends through the passive side.

14. The anchor system according to claim 12, wherein the body of the anchoring member is substantially semi-circular in shape, and comprises a flat passive side opposite a rounded operative side.

15. The anchor system according to claim 11, wherein the top surface of the base assembly comprises a cap having an aperture defined therein, further wherein the anchoring member is positioned to pivot through the aperture.

16. The anchor system according to claim 11, further comprising a retaining element for retaining the anchoring member in the operating position and in the retracted position.

17. The anchor system according to claim 16, wherein the retaining element comprises bearings positioned to bear against opposite ends of anchoring member when the anchoring member is in the operating position and in the retracted position, said bearings requiring a force to disengage with the anchoring member.

18. The anchor system according to claim 11, wherein the base assembly comprises a lower section securable in the ground, and an upper section adjustably secured to the lower section for adjusting an overall height of the base assembly.

19. A kit for anchoring an object, the kit comprising:

an anchor system comprising:

a base assembly having sidewalls defining a hollow interior, the base assembly comprising a lower section and an upper section having a substantially planar top surface, said upper section being adjustably secured to the lower section for adjusting an overall height of the base assembly; and an anchoring member pivotally secured to the base for anchoring the object to the base assembly, the anchoring member being configured as a closed loop and comprising a unitary body defining a central aperture, the anchoring member being pivotable about a pivot axis parallel to the top surface between an operating position in which the central aperture is exposed above the top surface of the base assembly, and a retracted position in which the central aperture extends in the hollow interior of the base assembly and is concealed below the top surface of the base assembly;

a tethering device for inserting through the central aperture of anchoring member while in the operating position, said tethering device having first and second ends; and a locking device for locking the first and second ends of the tethering device together to form a closed loop.

* * * * *